US006179761B1

(12) United States Patent
Isoda et al.

(10) Patent No.: US 6,179,761 B1
(45) Date of Patent: Jan. 30, 2001

(54) SEMICONDUCTIVE ROLLER

(75) Inventors: Masao Isoda; Hirokazu Ando; Takao Mizutani; Masayuki Suzuki, all of Tokyo (JP)

(73) Assignee: Oki Data Corporation, Tokyo (JP)

( * ) Notice: Under 35 U.S.C. 154(b), the term of this patent shall be extended for 0 days.

(21) Appl. No.: 09/431,032

(22) Filed: Nov. 1, 1999

(30) Foreign Application Priority Data

Nov. 2, 1998 (JP) ..... 10-312053

(51) Int. Cl.[7] ..... B25F 5/02
(52) U.S. Cl. ..... 492/59; 492/56
(58) Field of Search ..... 492/59, 56, 53; 428/36.9

(56) References Cited

U.S. PATENT DOCUMENTS 5,725,922 * 3/1998 Nakamura et al. ..... 428/36.9
5,984,849 * 11/1999 Ohki et al. .

FOREIGN PATENT DOCUMENTS

05156059 * 9/1993 (JP) .
405248426 * 9/1993 (JP) .
411295979 * 10/1999 (JP) .

* cited by examiner

*Primary Examiner*—I Cuda
(74) *Attorney, Agent, or Firm*—Rabin & Champagne PC

(57) ABSTRACT

A semiconductive roller has an electrically conductive shaft, a roller provided on the shaft formed of silicone rubber with carbon contained therein. The silicone rubber is also added olefin oil and zinc oxide. A method is used for manufacturing a semiconductive roller formed of an electrically conductive shaft. The method includes carrying out a first vulcanization where the semiconductive roller is shaped into a roller and carrying out a second vulcanization where the semiconductive roller is heated at 200° C. for substantially four hours.

3 Claims, 3 Drawing Sheets

FIG.2

| KIND OF ROLLER | NUMBER OF PRINTED PAGES (PAGES) | FLUIDITY (%) | AVERAGE TONER VOLTAGE (V) | AVERAGE TONER WEIGHT (mg/cm²) | TONER-CLINGING (%) | CURRENT THROUGH ROLLER (μA) | RESISTANCE (Ω) | |
|---|---|---|---|---|---|---|---|---|
| | | | | | | | RESISTANCE/ VARIATION | RATE OF CHANGE |
| ROLLER A1 | INITIAL | 77 | 64.2<br>43.4 | 0.59 | 4.00 | 2.9 | 2.33E+09<br>3.63 | |
| | 7.2K | 52 | 85.4<br>33.8 | 0.60 | 2.01 | 3.7 | 2.78E+09<br>6.92 | 1.19<br>1.91 |
| ROLLER B1 | INITIAL | 75 | 113<br>84.6 | 0.67 | 2.07 | 5.8 | 7.06E+08<br>3.96 | |
| | 7.2K | 20 | 92.6<br>39.2 | 0.65 | 3.71 | 4.8 | 7.24E+08<br>5.64 | 1.03<br>1.42 |
| ROLLER A2 | INITIAL | 89 | 118.6<br>86 | 0.76 | 1.57 | 6.3 | 4.97E+08<br>4.23 | |
| | 7.2K | 23 | 80.2<br>43.6 | 0.76 | 4.14 | 4.8 | 5.77E+08<br>9.23 | 1.16<br>2.18 |
| ROLLER A3 | INITIAL | 72 | 125.6<br>87.6 | 0.80 | 1.63 | 6.2 | 5.10E+08<br>9.60 | |
| | 7.2K | 33 | 74.8<br>35.2 | 0.60 | 3.33 | 5.1 | 6.19E+08<br>22.70 | 1.21<br>2.36 |
| ROLLER A4 | INITIAL | 69 | 126.2<br>87.4 | 0.83 | 1.28 | 6.5 | 4.83E+08<br>6.04 | |
| | 7.2K | 18 | 66.2<br>43 | 0.67 | 3.30 | 4.8 | 5.38E+08<br>8.14 | 1.11<br>1.35 |
| ROLLER C1 | INITIAL | 82 | 136.6<br>91.4 | 0.78 | 1.53 | 6.2 | 4.70E+08<br>3.42 | |
| | 7.2K | 27 | 94.2<br>42 | 0.62 | 3.82 | 5.5 | 4.75E+08<br>6.09 | 1.01<br>1.78 |
| ROLLER D1 | INITIAL | 84 | 70<br>53.4 | 0.64 | 4.30 | 4.1 | 2.16E+09<br>3.17 | |
| | 7.2K | 30 | 76.2<br>35 | 0.67 | 3.08 | 5 | 3.10E+09<br>4.92 | 1.44<br>1.55 |
| ROLLER D2 | INITIAL | 80 | 74.2<br>61.2 | 0.60 | 5.20 | 6.8 | 5.85E+08<br>3.55 | |
| | 7.2K | 17 | 82.8<br>34.6 | 0.63 | 5.66 | 5.8 | 7.88E+08<br>11.30 | 1.35<br>3.18 |
| (CONVEN-TIONAL) ROLLER E | INITIAL | 86 | 84<br>65 | 0.82 | 5.28 | 2.6 | 1.32E+08<br>2.26 | |
| | 7.2K | 17 | 127<br>61 | 1.33 | 3.52 | 5.9 | 2.01E+07<br>4.87 | 0.15<br>2.15 |

FIG.3

| KIND OF ROLLER | CELL SIZE | NUMBER OF PRINTED PAGES (PAGES) | FLUIDITY OF TONER (%) | AVERAGE TONER VOLTAGE (V) | AVERAGE TONER WEIGHT (mg/cm²) | TONER-CLINGING (%) | CURRENT THROUGH ROLLER (μA) | RESISTANCE (Ω) | | HARD-NESS | IMAGE QUALITY |
|---|---|---|---|---|---|---|---|---|---|---|---|
| | | | | | | | | RESISTANCE/ VARIATION | RATE OF CHANGE | | |
| ROLLER B2 | FINE | INITIAL | 75 | 80.2<br>55.6 | 0.55 | 3.97 | 3.3 | 5.21E+09<br>2.09 | 0.81<br>2.14 | 84.9 | |
| | | 7.2K | 20 | 71.4<br>25.6 | 0.52 | 1.60 | 4.2 | 4.21E+09<br>4.47 | | | BLUR<br>35 |
| ROLLER A5 | FINE | INITIAL | 80 | 66<br>53.2 | 0.61 | 4.86 | 2.2 | 6.04E+09<br>2.17 | 1.19<br>2.34 | 86.4 | |
| | | 7.2K | 23 | 67.2<br>26.8 | 0.79 | 1.98 | 2.9 | 7.18E+09<br>5.07 | | | BLUR<br>50 |
| ROLLER A6 | FINE | INITIAL | 86 | 91<br>69.2 | 0.67 | 2.61 | 3.4 | 3.41E+09<br>2.13 | 1.19<br>1.83 | 85.8 | |
| | | 7.2K | 30 | 100<br>34.6 | 0.59 | 3.35 | 4.4 | 4.07E+09<br>3.90 | | | BLUR<br>55 |
| ROLLER A7 | FINE | INITIAL | 72 | 114.4<br>81.6 | 0.76 | 1.59 | 5.35 | 9.48E+08<br>2.84 | 1.54<br>2.14 | 85.0 | |
| | | 7.2K | 43 | 84.2<br>37.6 | 0.65 | 4.06 | 5.9 | 1.46E+09<br>6.07 | | | BLUR<br>55 |
| ROLLER C2 | FINE | INITIAL | 73 | 70.8<br>52.8 | 0.60 | 4.47 | 2 | 5.21E+09<br>2.35 | 1.23<br>2.08 | | |
| | | 7.2K | 7 | 62<br>25.2 | 0.65 | 2.83 | 2.8 | 6.39E+09<br>4.88 | | | BLUR<br>45 |
| ROLLER B3 | COARSE | INITIAL | 75 | 113<br>84.6 | 0.67 | 2.07 | 5.8 | 7.06E+08<br>3.96 | 1.03<br>1.42 | 82.2 | |
| | | 7.2K | 20 | 92.6<br>39.2 | 0.65 | 3.71 | 4.8 | 7.24E+08<br>5.64 | | | SOME BLUR<br>70 |
| ROLLER A8 | COARSE | INITIAL | 77 | 64.2<br>43.4 | 0.59 | 4.00 | 2.9 | 2.33E+09<br>3.63 | 1.54<br>1.91 | 80.5 | |
| | | 7.2K | 52 | 85.4<br>33.8 | 0.60 | 2.01 | 3.7 | 3.58E+09<br>6.92 | | | SOME BLUR<br>70 |
| ROLLER A9 | COARSE | INITIAL | 72 | 125.6<br>87.6 | 0.80 | 1.63 | 6.2 | 5.10E+08<br>9.60 | 1.21<br>2.36 | 84.5 | |
| | | 7.2K | 33 | 74.8<br>35.2 | 0.60 | 3.33 | 5.1 | 6.19E+08<br>22.70 | | | SOME BLUR<br>60 |
| ROLLER C3 | COARSE | INITIAL | 82 | 136.6<br>91.4 | 0.78 | 1.53 | 5.2 | 4.70E+08<br>3.42 | 1.01<br>1.78 | 80.5 | |
| | | 7.2K | 27 | 94.2<br>42 | 0.62 | 3.82 | 5.5 | 4.75E+08<br>6.09 | | | BLUR<br>55 |

SEMICONDUCTIVE ROLLER

BACKGROUND OF THE INVENTION

1. Field of the Invention

The present invention relates to a semiconductive roller and a method of manufacturing the semiconductive roller.

2. Description of the Related Art

With a conventional electrophotographic printer, a charging roller charges the surface of the photoconductive drum and an exposing unit such as an LED head writes an electrostatic latent image on the charged surface of the photoconductive drum. The electrostatic latent image is then developed with toner into a visible image, i.e., toner image. The toner image is subsequently transferred to a print medium when the print medium passes in a sandwiched relation between the photoconductive drum and a transfer roller. The transfer roller receives a high voltage of about several hundred to several thousand volts and of an opposite polarity to the toner. An electric field developed between the photoconductive drum and the transfer roller causes the toner image to be attracted to the print medium. Thus, the toner image is transferred to the print medium.

Some of the toner fails to be transferred from the photoconductive drum to the print medium. Such residual toner is distributed evenly on the surface of the photoconductive drum by a cleaning unit. A developing unit subsequently collects the evenly distributed residual toner.

A toner cartridge supplies fresh, unused toner into a toner container, which in turn supplies the toner to the developing roller via an agitating bar and a semiconductive sponge roller. When the sponge roller transports the toner, the toner is charged. The sponge roller is in the form of a conductive silicone rubber that contains silicone polymer and carbon as a conductive agent. The conductive silicone rubber is foamed to have a large number of holes referred to as cells having diameters in the range from 0.3 to 0.5 mm. The sponge roller serves to ensure required print density and prevent variations in print density over time. The sponge roller is incorporated in a print process unit, which is a mechanical section of an electrophotographic printer.

The problem with the aforementioned conventional sponge roller is that as the cumulative number of printed pages increases, the carbon contained in the material tends to clump, increasing conductivity. An increased conductivity decreases the electrical resistance of the sponge roller. As a result, a larger current flows through the sponge roller. This results in a steep increase in toner potential so that more toner than necessary is supplied to the developing roller, especially to longitudinal ends of the developing roller which have relatively lower electrical resistance. Thus, excessive toner falls in the electrophotographic printer so that the print medium opposing the longitudinal ends of the developing roller becomes black. The toner deposited on the developing roller forms a "ring" that surrounds the developing roller, and is referred to as "toner ring" in this specification.

SUMMARY OF THE INVENTION

An object of the invention is to provide a semiconductive roller in which carbon contained in the roller does not clump.

Another object of the invention is to provide a semiconductive roller in which when an external force is applied to the roller, the electrical resistance of the roller changes less as compared to a conventional roller having olefin oil added thereto.

A still another object of the invention is to provide a semiconductive roller having small manufacturing variation of the electrical resistance of the roller.

A semiconductive roller includes an electrically conductive shaft, a roller provided on the shaft formed of silicone rubber with carbon contained therein. The silicone rubber preferably contains 100 parts of silicone rubber, 0.4 parts of olefin oil, and 30 parts of zinc oxide by weight.

A method is used for manufacturing a semiconductive roller formed of an electrically conductive shaft. The method includes carrying out a first vulcanization where the semiconductive roller is shaped into a roller, and carrying out a second vulcanization where the semiconductive roller is heated at 200° C. for substantially four hours.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus do not necessarily limit the scope of the present invention, and wherein:

FIG. 2 illustrates experimental results of the first embodiment; and

FIG. 3 illustrates experimental results of a second embodiment.

DESCRIPTION OF THE INVENTION

Figure 1:
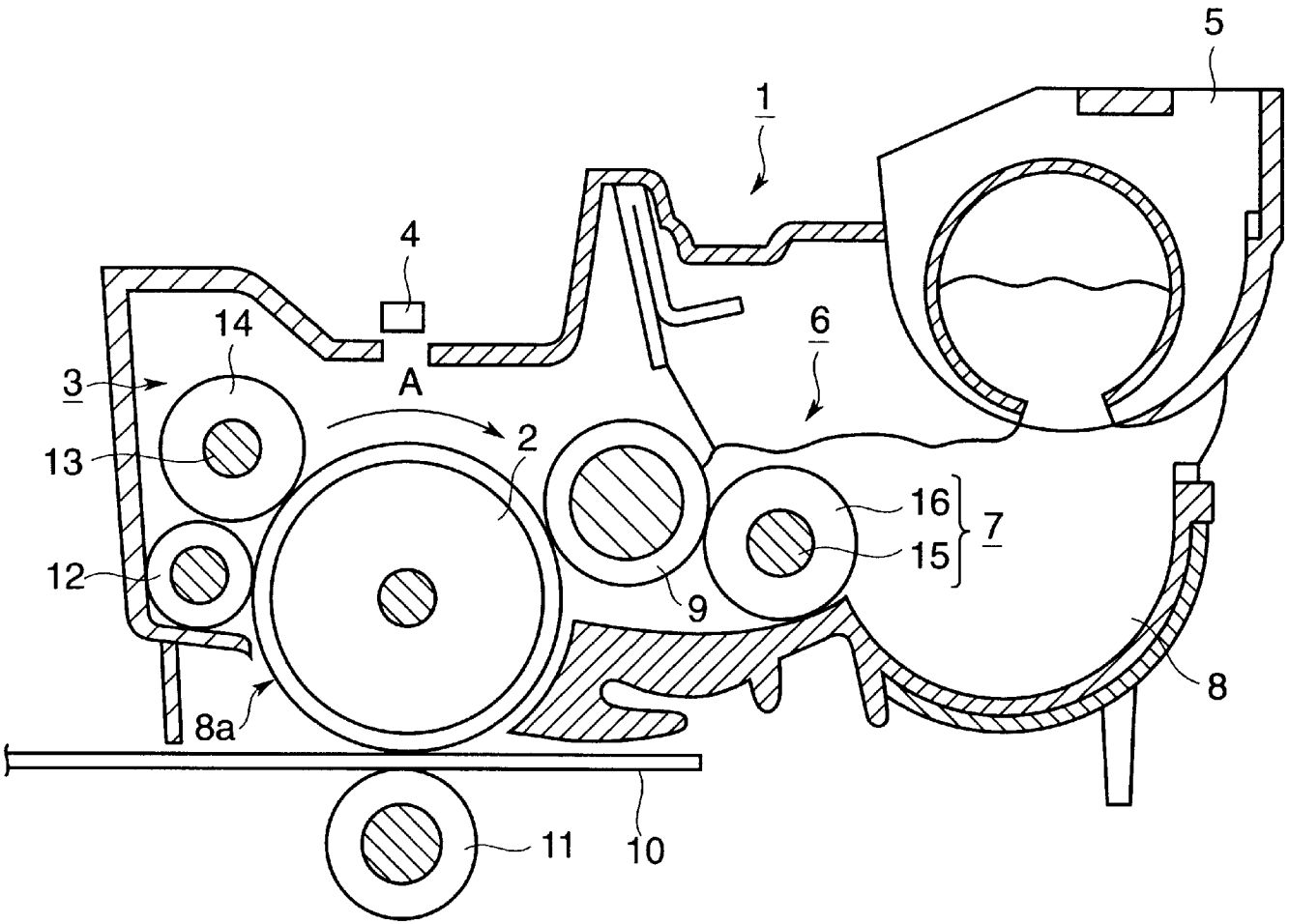
FIG. 1 illustrates a structure of the print process unit according to a first embodiment.

Preferred embodiments of the present invention will be described in detail with reference to the accompanying drawings. Elements of the same construction have been given the same reference numerals throughout the embodiments and the description thereof is omitted.

First Embodiment

<Construction>

FIG. 1 illustrates a structure of a print process unit according to a first embodiment.

The structure of the print process unit 1 incorporated in an electrophotographic printer will be described.

Referring to FIG. 1, the print process unit 1 includes a photoconductive drum 2 that has an electrical conductive base such as aluminum covered with a photoconductive layer. The photoconductive layer holds a toner image thereon. The photoconductive drum 2 is driven to rotate in a direction shown by arrow A at a predetermined process speed. Provided around the photoconductive drum are a charging roller 3, an LED head 4, developing roller 9, a transfer roller 11, and a cleaning roller 12. The charging roller 3 includes a conductive shaft 13 and a roller body 14. The conductive shaft 13 receives a negative voltage so that the surface of the photoconductive drum 2 is charged via the roller body 14. The LED head 4 illuminates the charged surface of the photoconductive drum 2 to form an electrostatic latent image on the photoconductive drum 2. Toner is supplied to a toner container 6 in which the toner is agitated by an agitating bar, not shown. A sponge roller 7 supplies the toner stored in the toner container 6 to the developing roller 9, which in turn supplies the negatively charged toner to the electrostatic latent image on the photoconductive drum 2. The transfer roller 11 is in pressure contact with the surface of the photoconductive drum 2 and transfers the toner image on the photoconductive drum 2 to print paper 10 as a print medium that is transported by feed rollers, not shown. The cleaning roller 12 receives a positive voltage of 450 V so that the cleaning roller 12 attracts residual toner 8*a* having a polarity opposite to the positive voltage of 450 V to clean the surface of the photoconductive drum 2. The residual toner attracted to the cleaning roller 12 is again transferred to the photoconductive drum 2 during the cleaning operation and collected by the developing roller 9.

A fixing unit, not shown, is provided downstream of the print process unit 1 in the transport path of the print paper 10, and fixes the toner 8 transferred to the print paper 10. The fixing unit incorporates a heat roller.

The developing roller 9 and sponge roller 7 form a developing unit. The sponge roller 7 includes a metal shaft 15 that receives a voltage and a roller 16 that is fixed to the shaft 15 and surrounds the shaft 15. The roller 16 is formed of a silicone rubber having olefin oil and zinc oxide (ZnO) added thereto. Olefin oil is used to prevent carbon from clumping and zinc oxide (ZnO) is used to prevent variation in the internal resistance of the roller 16. The roller 16 is foamed to have a large number of holes called "cells" having diameters in the range from 0.3 (fine) to 0.5 (coarse) mm.

The sponge roller 7 has small variations of resistance and can prevent the clumping of the carbon, thus preventing the increase in toner potential due to decreased resistance resulting from changes of characteristics of the sponge roller over time. Also, an appropriate amount of toner can be supplied to the developing roller 9.

<Test Results>

The thus manufactured sponge roller 7 is assembled into the print process unit 1.

The following parameters were investigated:

(1) The fluidity of toner (2) Potential of the toner 8 on the developing roller 9

(3) The weight of toner 8 on the developing roller 9

(4) The current flowing through the sponge roller 7

(5) Unwanted deposition of toner on the photoconductive drum (6) Electrical resistance of the sponge roller 7

All of the parameters have values taken immediately after the sponge roller 9 have been assembled and again after 7200 pages have been printed (i.e., when the toner 8 is nearing exhaustion.)

Experiments were conducted to evaluate the sponge rollers (i.e., Roller A to Roller D) according to the present invention. The experiments revealed that the best proportions of silicone, olefin oil, and zinc oxide (ZnO) are 100 parts, 0.4 parts, and 30 parts, respectively, by weight. The amount of carbon to be added is determined by the desired electrical resistance of the sponge roller. In the present embodiment, the carbon in the range from 2 to 2.5 parts is added.

Table I lists the rollers tested.

TABLE I

| Roller | Silicon rubber base (parts) | Zinc oxide, ZnO (parts) | Olefin oil (parts) | Second vulcanization (hour) | Carbon (parts) |
|---|---|---|---|---|---|
| Roller A1-A4 | 100 | 30 | 0.4 | 4 | 2–2.5 |
| Roller B1 | 100 | 30 | 0.4 | 2 | 2–2.5 |
| Roller C1 | 100 | 30 | 0.4 | 7 | 2–2.5 |
| Roller D1-D2 | 100 | 50 | 0.4 | 4 | 2–2.5 |

FIG. 2 illustrates experimental results of the first embodiment. Data are shown for the first printed pages and for pages after 7200 pages have been printed.

The major data listed in FIG. 2 are as follows:

(1) Fluidity of toner 8 in percent after printing 7200 pages (2) Potential of toner 8 on the developing roller 9

(3) Average weight of toner 8 in milligrams per square centimeters ($mg/cm^2$) deposited on the developing roller 9

(4) Toner-clinging in percent (5) Current in micro amperes flowing through the sponge roller (6) Resistance in ohms of the sponge roller 7

"Average toner voltage" is a voltage of charged toner remaining on the developing roller when the printer is momentarily turned off in the middle of printing a black solid image.

When a printing is actually, an image printed on a page of printing medium tends to have high density for the first one rotation of the sponge roller and low density for the second rotations onward. This is due to the difference in toner voltage. Thus, FIG. 2 shows both average toner voltages for the first one rotation of the sponge roller 7 and for the second rotation onward. For example, for Roller A1, the average toner voltage is 64.2 V for the first rotation of the sponge roller 7 and 43.4 V for the second rotation onward.

"Average toner weight" is the weight of toner per unit area ($mg/cm^2$) remaining on the developing roller 9 when the printer is turned off momentarily.

In this specification, the term "toner-clinging" is used to cover the following phenomenon. An insufficiently small difference in potential between the surface of the photoconductive drum 2 and the surface of the developing roller 9 causes the developer toner to cling to the background of the latent image formed on the photoconductive drum 2, leading to soiling of the surface of the photoconductive drum 2.

The resistance of the sponge roller 7 and variation of the resistance are shown for each roller. For example, for Roller A1, the resistance is 2.33E+09 Ω (=$2.33\times10^9$ Ω) and the variation of the resistance is 3.62. The resistances are measured a plurality of times (e.g. 100 times) at each of a plurality of locations on the surface of the sponge roller, for example, 6 locations, during one complete rotation of the sponge roller. Then, the maximum and minimum values of resistances at each location are determined and then an average value of the maximum and minimum values is calculated as the resistance of the sponge roller. "Variation" is a maximum value divided by a minimum value.

"Rate of change" is a ratio of the resistance of the sponge roller 7 for pages after 7200 pages have been printed to the resistance of the sponge roller 7 for first pages. For Roller A1, the rate of change is 2.78E+09/2.33E+09=1.19.

Referring to FIG. 2, Rollers A1–A4, B1, C1, and D1 have smaller differences in resistance between the initial pages and pages after 7200 pages have been printed, as compared to the conventional sponge roller (i.e., Conventional Roller E). For example, the rate of change of the resistance of the sponge roller is 1.19 (2.78E+09/2.33E+09=1.19) for Roller A1, and 0.15 for the Conventional Roller. Therefore, changes in current flowing through Rollers A1–A4, B1, C1, and D1 are small after a large number of pages have been printed. As a result, the potential of the toner is relatively low and stable, so that a sufficient amount of toner 8 is supplied to the developing roller 9. For example, the current flowing through Roller A1 are 2.9 $\mu$A for first pages and 3.7 $\mu$A for pages after 7200 pages have been printed, respectively. The aforementioned Rollers A1–A4, B1, C1, and D1 were manufactured and assembled into the print process unit 1 to test for toner ring. Little or no toner ring occurred.

The printing of 7200 pages is a general measure that an electrophotographic printer can print before the toner 8 in the toner cartridge 5 is exhausted. The electrophotographic printer is assumed to be of a type in which the toner cartridge 5 is replaced when the toner 8 is exhausted. If the electrophotographic printer can still print normally after having printed 7200 pages, then changes in various characteristics will be smaller after printing 7200 pages, so that there will be no chance of toner ring occurring for the rest of the lifetime of the printer.

Adding olefin oil to the sponge roller prevents the clumping of the carbon contained in the silicone rubber. Changes in resistance when external stresses are exerted to the roller are small as compared to the rollers that are not added olefin oil. Adding zinc oxide (preferably 30 parts) minimizes variation of electrical resistance.

This reduces the difference in the resistance of the sponge roller 7 between when the first few pages are printed and when 7200 pages have been printed. Therefore, the current that flows through the sponge roller 7 does not change significantly over time, so that the potential of the toner 8 will not rise steeply and the amount of toner supplied to the developing roller 9 remains substantially constant over time. The stable supply of toner prevents toner ring that results from excessive toner supplied to the developing roller 9, thereby preventing rapid exhaustion of toner in the toner cartridge.

Second Embodiment

FIG. 3 illustrates experimental results of a second embodiment.

The base material of the sponge roller 16 according to the second embodiment is also semiconductive silicone rubber formed of silicone polymer and carbon. The base material also contains olefin oil and zinc oxide. Thus, the composition of the sponge roller 7 of the second embodiment is the same as the first embodiment. The second embodiment is characterized in the method of manufacturing the sponge roller 7.

Conventionally, the sponge roller is subjected to a first vulcanization and subsequently to a second vulcanization. During the first vulcanization, the silicone rubber is shaped into a roller body 16 formed around a metal shaft. During the second vulcanization, the roller body 16 is given the properties of rubber, and the oligomer is removed therefrom. The second vulcanization is performed for seven hours at a temperature of 225° C.

Olefin oil added to the roller body 16 causes the roller body 16 to deform when the roller body 16 is heated to 225° C. Thus, the second embodiment differs from the first embodiment in the conditions of the second vulcanization.

A base material containing olefin oil and zinc oxide was manufactured. This composition is the same as in the first embodiment. Then, three types of sponge rollers, i.e., Rollers A5–A9, Rollers B2–B3, and Rollers C2–C3 were prepared and tested at three different conditions of the second vulcanization; heat treatments at 200° C. for about two hours (Rollers A5–A9), 200° C. for about fourhours (Rollers B2–B3), and 200° C. for sevenhours (Rollers C2–C3). In order to prevent the olefin oil from denaturing, the second vulcanization is preferably carried out at a temperature below 200° C. Three different sponge rollers 7 (Rollers A5–A9, B2–B3, and C2–C3) were made using the three different rollers 16. The three different sponge rollers 7 were assembled into corresponding print process units 1.

Then, the following properties were investigated:

(1) The fluidity of toner (2) The potential of the toner 8 on the developing roller 9

(3) The weight of toner 8 on the developing roller 9

(4) Current flowing through the sponge roller 7

(5) Toner clinging and (6) The electrical resistance of the sponge roller 7

All of these data values were measured immediately after the sponge roller 7 has been assembled into the printer and after 7200 pages have been printed, i.e., when the toner 8 has almost exhausted.

FIG. 3 shows that Roller B2 (vulcanized at 200° C., 4 hour) provides the best fluidity of toner and the least deterioration of toner after 7200 pages have been printed. Rollers A5–A9 (vulcanized at 200° C., 2 hour) retain too much oil that impairs the fluidity of the toner. Rollers C2–C3 (vulcanized at 200° C., 7 hour) provide poor fluidity of toner because the olefin oil has dried up and silica contained in the toner is stuck to the silica contained in the roller body 16. Thus, it is concluded that the sponge roller 7 formed of a roller body containing olefin oil and zinc oxide should preferably be subjected to the second vulcanization at 200° C. for four hours.

In addition to the advantages of the first embodiment, Rollers B2–B3 of the second embodiment prevent the fluidity of toner from decreasing when the toner 8 in the toner container 6 is nearing exhaustion. Thus, the second embodiment reduces the chance of blurred print results occurring.

While the first and second embodiments have been described with respect to a sponge roller 7 made of silicone rubber with olefin oil and zinc oxide added thereto, the invention may be applicable to other sponge-like rollers.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A semiconductor roller, comprising:

an electrically conductive shaft;

a roller provided on said shaft said roller being formed of a silicone rubber material, with carbon, olefin oil and zinc oxide being contained within the silicone rubber material, wherein the olefin oil prevents the carbon from clumping over time.

2. The semiconductive roller according to claim 1, wherein the silicone rubber material contains 100 parts of a silicone rubber base, 0.4 parts of the olefin oil, and 30 parts of the zinc oxide by weight.

3. The semiconductive roller according to claim 2, wherein the roller is vulcanized at 200° C. for 4 hours so that the roller is given rubber properties and any oligomer is removed.

* * * * *